United States Patent [19]

Owens et al.

[11] Patent Number: 4,637,608

[45] Date of Patent: Jan. 20, 1987

[54] COMPACT MULTIPLE PURPOSE EXERCISE BENCH

[75] Inventors: Brian T. Owens, Meriden; Fredrick W. Corona, Hamden, both of Conn.

[73] Assignee: Wallingford Barbell Company, Wallingford, Conn.

[21] Appl. No.: 610,325

[22] Filed: May 15, 1984

[51] Int. Cl.[4] ..... A63B 21/00

[52] U.S. Cl. ..... 272/134; 272/123; 272/144

[58] Field of Search ..... 272/117, 118, 123, 134, 272/144, DIG. 4; 297/363

[56] References Cited

U.S. PATENT DOCUMENTS

| | | | |
|---|---|---|---|
| 2,283,475 | 5/1942 | Wagner | 272/134 X |
| 2,771,124 | 11/1956 | Borsani | 297/363 X |
| 2,944,592 | 7/1960 | Halter | 272/134 X |
| 3,625,511 | 12/1971 | Rennemann | 272/134 X |
| 3,850,430 | 11/1974 | Hamilton | 272/117 |
| 4,188,029 | 2/1980 | Brower et al. | 272/118 X |
| 4,211,403 | 7/1980 | Coffaro et al. | 272/134 X |
| 4,252,314 | 2/1981 | Ceppo | 272/123 X |
| 4,286,782 | 9/1981 | Fuhrhop | 272/123 X |
| 4,290,597 | 9/1981 | Schleffendorf | 272/117 |
| 4,319,747 | 3/1982 | Rodgers | 272/123 X |
| 4,358,108 | 9/1982 | Voris | 272/134 X |
| 4,382,596 | 5/1983 | Silberman | 272/134 X |
| 4,470,596 | 9/1984 | Desiderio | 272/118 |

FOREIGN PATENT DOCUMENTS

| | | | |
|---|---|---|---|
| 3212544 | 10/1983 | Fed. Rep. of Germany | 272/144 |
| 84/01303 | 4/1984 | PCT Int'l Appl. | 272/144 |
| 2065482 | 7/1981 | United Kingdom | 272/134 |
| 2076299 | 12/1981 | United Kingdom | 272/144 |
| 2106399 | 4/1983 | United Kingdom | 272/144 |

OTHER PUBLICATIONS

Advertisement for "Excel", *The Sporting Goods Dealer*, p. 102.

Newsweek, Sep. 14, 1981, p. 43.

*Primary Examiner*—Richard J. Apley
*Assistant Examiner*—Robert W. Bahr
*Attorney, Agent, or Firm*—Bachman & LaPointe

[57] ABSTRACT

A compact exercise bench with accessories adjustable to a variety of configurations to facilitate performing a large variety of body conditioning exercises for improving physical fitness.

1 Claim, 14 Drawing Figures

COMPACT MULTIPLE PURPOSE EXERCISE BENCH

BACKGROUND OF THE INVENTION

The present invention relates to physical fitness and relates in particular to apparatus and machines facilitating performance of a wide variety of fitness exercises.

Many prior art exercise devices are limited to the performance of one or two exercises and this situation requires a large number of different individual machines in order to perform the numerous exercises common to the classical fitness program.

For example, in some prior art devices, one machine is used to perform leg extensions, another separate machine for arm curl and still others for rowing, pressing, arm extensions and so forth.

A major disadvantage to the requirement of numerous machines is cost of the collective units and the need for a large area for machine setup.

Other prior art exercise machines upon which one can perform several exercises are complicated, require a large setup area and are not easily converted from one exercise mode to another.

Typical examples of prior art devices which have limited versatility or which have several exercise modes are shown and described in U.S. Pat. No. 4,396,191 to Metler, U.S. Pat. No. 4,411,425 to Milnar and U.S. Pat. No. 4,369,966 and U.S. Pat. No. 4,382,596 to Silberman.

The '191 patent shows adjustable barbell supports and an adjustable body support. The '425 patent discloses a bench press safety device.

The '966 and '596 patents show a complicated device having an intricate tubular structure which requires bolts, nuts and other fasteners for setup, adjustment and conversion.

SUMMARY OF THE INVENTION

In contrast the present invention contemplates a simple, compact exercise device having attachments facilitating the performance of a wide variety of fitness exercises.

Accordingly, it is a principal feature of the present invention to provide a simple exercise bench with a variety of accessories which can be attached or removed with a minimum of effort and without complications.

It is a further feature of the invention to provide a compact exercise device suitable for home or office use.

A further feature of the invention is the provision of an exercise device with a variety of strong, lightweight accessories which facilitate as many as fifteen to twenty different fitness exercises.

A further feature of the invention is the provision of an exercise bench, the main body of whose attachments and accessories are received and supported in sockets in telescoping fashion where the sockets are also structural elements of the bench.

A further feature of the present invention is the provision of a low cost exercise unit which lends itself to modern high speed mass production methods.

A still further feature of the invention is the provision of an exercise bench with a variety of accessories and adjustment modes which can be accomplished by a youth or a housewife in the home.

An exercise bench embracing certain features of the present invention may comprise a pair of spaced tubular frames spanned and supported by a central beam, a diagonal support element connecting the base of each frame to the central beam to provide rigidity to the truss, a first section of said body support being fixed to the truss, a second section of said body support being hinged to the truss, a pair of spaced brackets fixed to the second section straddling said beam and indexing means on said brackets cooperating with said central beam for positioning said second section of said body support releasably in a plurality of angular positions relative to said first section of said body support.

BRIEF DESCRIPTION OF THE DRAWINGS

Other features and advantages of the present invention will be more apparent from an examination of the succeeding specification when read in conjunction with the appended drawings, in which.

DETAILED DESCRIPTION

Figure 2:
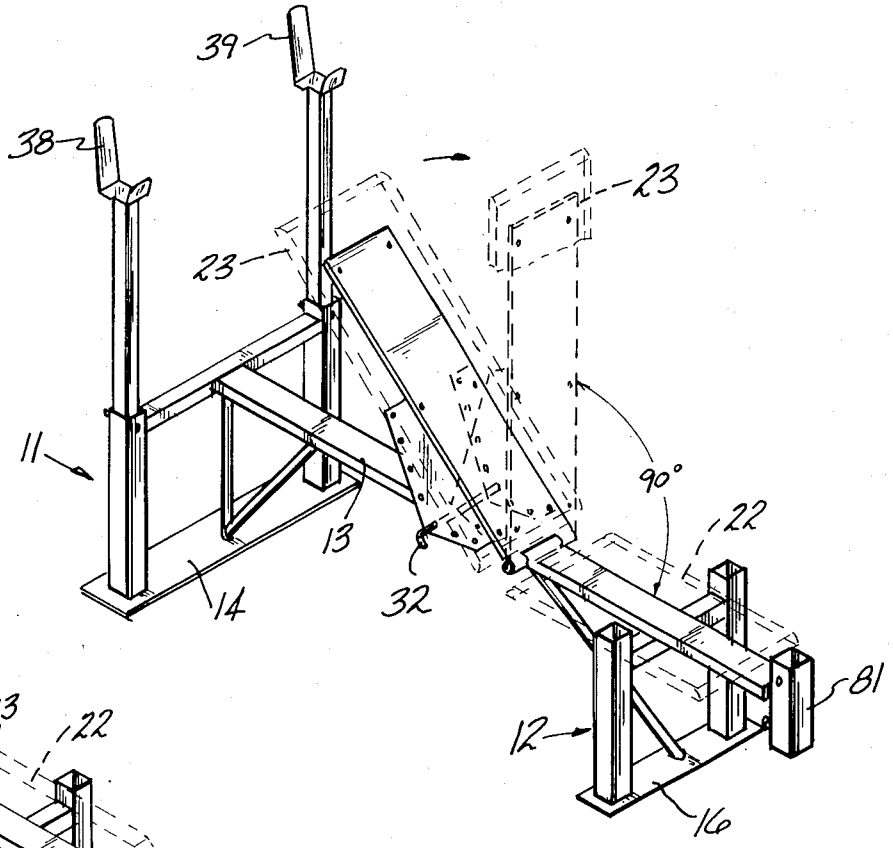
FIG. 2 is a similar view showing a hinged section of a body support.
Figure 1:
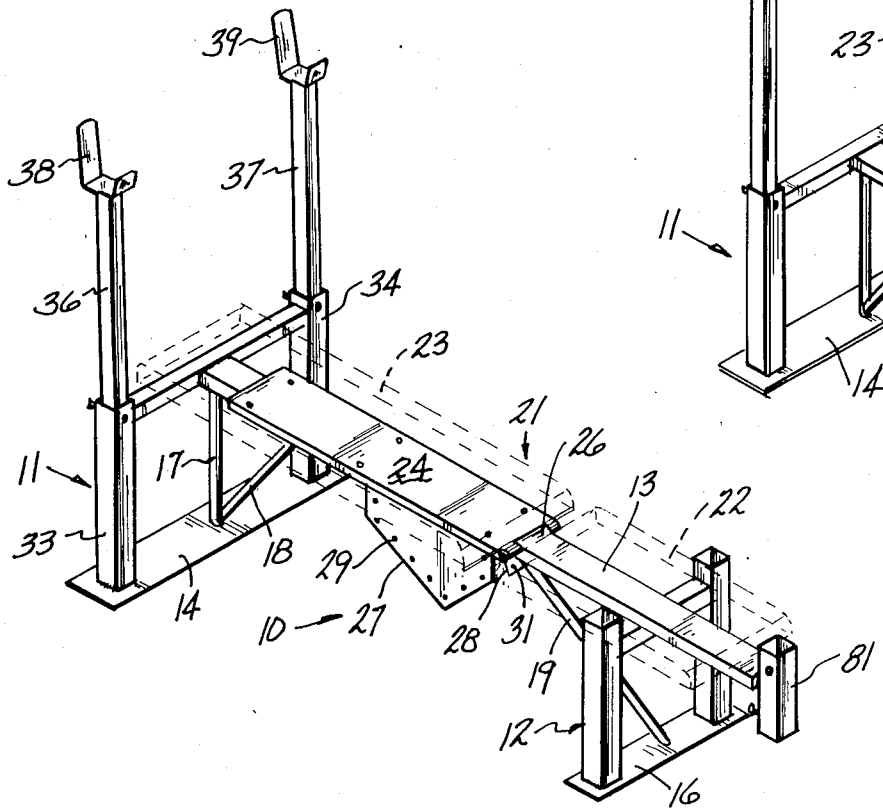
FIG. 1 is a perspective view of the basic bench.

Referring now in detail to the drawings, in particular FIGS. 1 and 2, the reference numeral 10 designates the basic exercise bench generally defining a truss in which a first tubular frame 11 is connected to a second tubular frame 12 by a central beam 13 spanning both frames.

Frames 11 and 12 are fixed to mating floor plates 14 and 16 which, in turn, may be secured by lag bolts or the like to the floor, as desired.

Vertical strut 17 and diagonal struts or support elements 18 and 19 provide rigidity to the truss structure.

A cushioned, normally flat body support 21 indicated in dotted lines includes a first section 22 fixed to the truss by attachment to the central beam 13.

A second section 23 of the normally flat body support is hinged to the truss via central beam 13 in that a flat plate 24 (to which cushioned section 23 is secured) is hinged to the central beam 13 at a point indicated by the reference numeral 26.

The plate 24 supports a pair of spaced brackets 27 and 28 each having an array of registered apertures 29–31 defining a graduated scale.

The brackets scale cooperates with a removable through pin 32 and central beam 13 to define an indexing means for positioning the second section 23 of the body support through a variety of angular positions ranging from the normally flat position of FIG. 1 to a vertical position shown in dotted lines in FIG. 2.

Note that the second section 23 is retained in any desired inclined position by rotating the section about its hinge. When the registered apertures 29 and 31 correspond to the desired angular position the pin 32 is inserted (see FIG. 2) so that it overlays the central beam thus locking the section releasably in the desired inclined position.

Obviously, it is entirely within the scope of this invention to lay out the brackets with any incremental index or graduated angular scale desired.

The first tubular frame 11 includes wells or sockets 33–34 which in the illustrated embodiment of the invention have a rectangular (square) configuration in cross-section.

Obviously, the cross-section could be circular if desired.

A pair of supports 36 and 37 having barbell horns 38 and 39 are received removably and in telescoping fashion mating sockets.

Suitable fastening means (not shown) may be provided on either tbe sockets 33–34 or the supports 36–37 for securing and regulating the height of the supports and the barbell horns relative to the sockets.

When the body support 21 is in the inclined position of FIG. 2, it is difficult, if not impossible, for an exerciser upon the inclined support to grasp a barbell disposed in horns 38 and 39.

Figure 5:
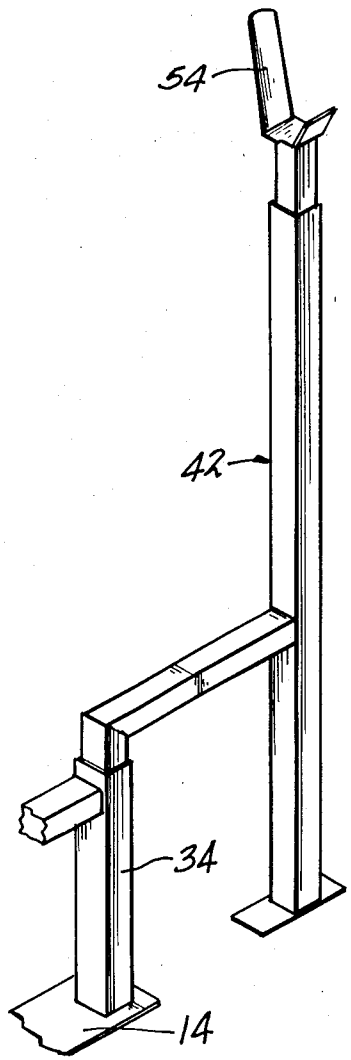
FIG. 5 shows a stanchion in a side or competition position.
Figure 4:
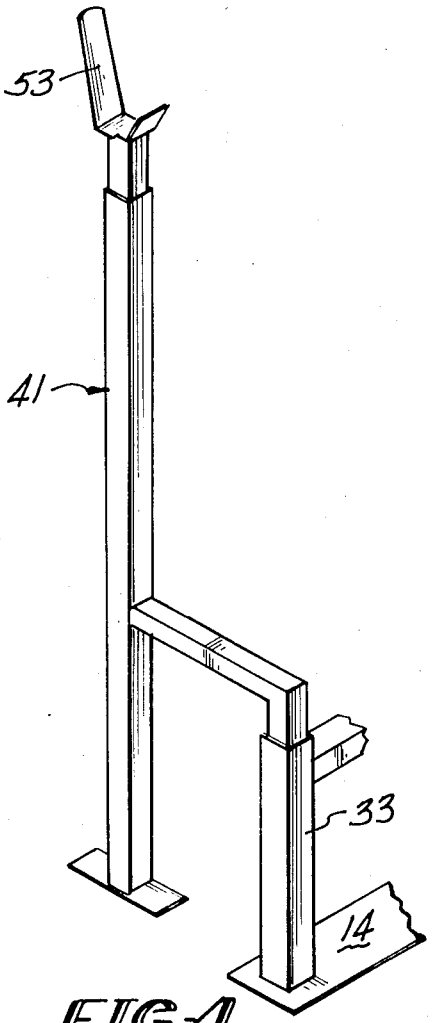
FIG. 4 shows a barbell stanchion in a rear position.
Figure 3:
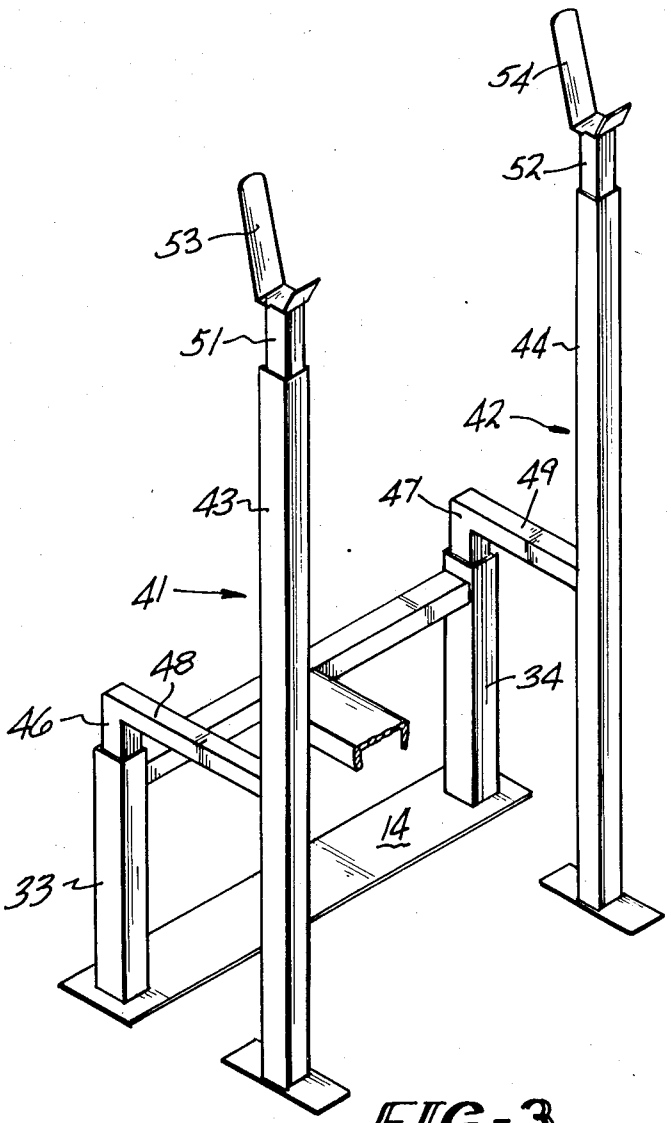
FIG. 3 is a view of a portion of the left end of the bench of FIG. 1 with barbell stanchions in a forward position.

To overcome this difficulty, a modified pair of supports 41 and 42 are provided as shown in FIGS. 3, 4 and 5 which are also telescopically received in sockets 33–34.

The modified supports define an H-shaped configuration including a main stanchion 43–44 offset from mating supports 46 and 47 by arms 48 and 49.

Each stanchion 43–44 also receives in telescoping fashion (with appropriate vertical adjustment clamps) a stanchion extension 51 and 52 supporting barbell horns 53 and 54.

In FIG. 3 the modified supports are shown in the forward position, i.e., to the right relative to the supports 36 and 37 of FIGS. 1 and 2.

FIG. 4 illustrates the rear position (only one shown) and FIG. 5 shows the side or "competition" position.

In the competition position the horns 53 (not shown in FIG. 5) and 54 must be removed, rotated 90° and inserted so as to be in correct position to receive a barbell.

Figure 6:
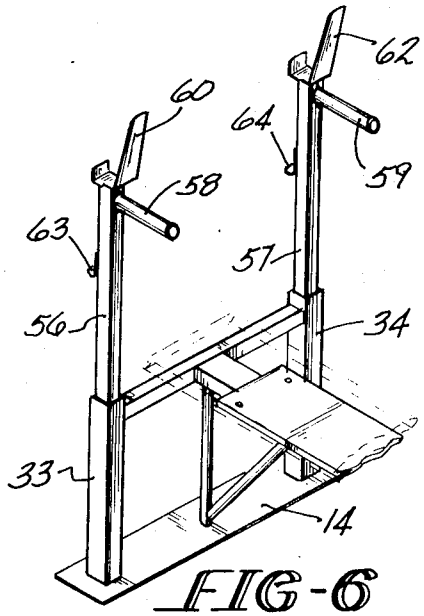
FIG. 6 shows the left end of the illustration of FIG. 1 with "dip" exercise supports in place.

FIG. 6 shows a still further accessory which is conveniently and telescopically inserted into the sockets 33 and 34. Here, supports 56 and 57 carry stub shafts 58 and 59, barbell horns 61 and 62 and barbell safety cradles 63 and 64.

In this arrangement an exerciser grasps the shafts 58 and 59 (abbreviated parallel bars) to perform "dips".

The barbell horns 61 and 62 facilitate squats from a floor-standing position.

Figure 7:
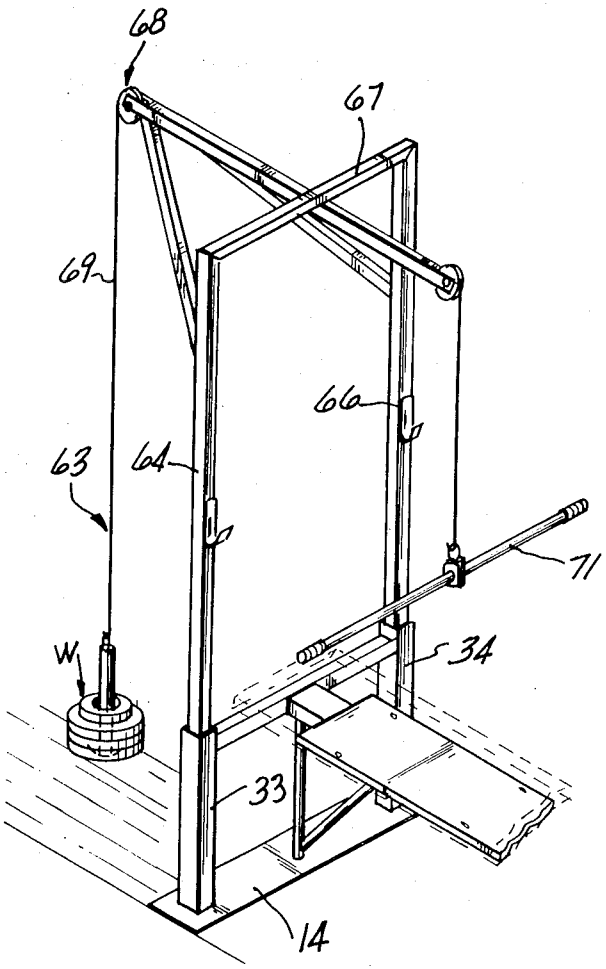
FIG. 7 shows the left end of the illustration of FIG. 1 with the pulley work assembly in place.

In FIG. 7 there is a still further accessory shown for telescopic attachment to the left end of the bench as viewed in FIGS. 1 and 2.

This accessory, identified generally by the reference numeral 63, includes uprights 64 and 66 joined by a cross member 67, in turn supporting pulley assembly 68. A flexible cable 69 is connected to a stack of weights W and the opposite end of the cable terminates in a pull bar 71.

In this arrangement an exerciser is able to perform lat pull down exercises wherein an individual straddles the bench facing or with his back to the pulley assembly. Obviously, the uprights 64 and 66 are telescopically received and are adjustable in the mating sockets 33 and 34.

Figure 8:
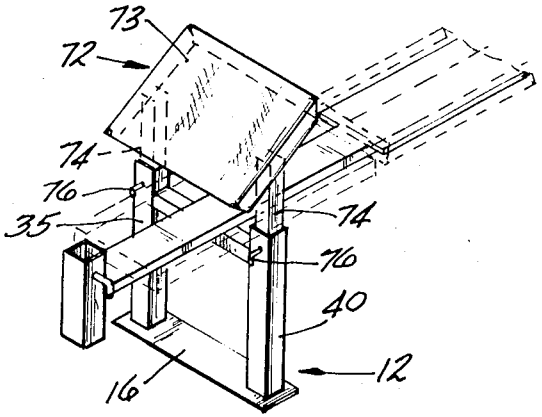
FIG. 8 shows the right end of the illustration of FIG. 1 with the arm curl accessory in place.

FIG. 8 shows an accessory mounted at the forward or right end of the bench of FIG. 1 identified by the reference numeral 72 and defining an arm curl unit or a secondary body support in that an upper arm rest 73 having depending legs 74—74 is received in telescoping fashion in mating sockets 35 and 40. Adjustment means 76 are provided on either legs 74—74 or sockets 35–40 to adjust the vertical position of the rest 73 to accommodate the physical stature of the exerciser.

Figure 9:
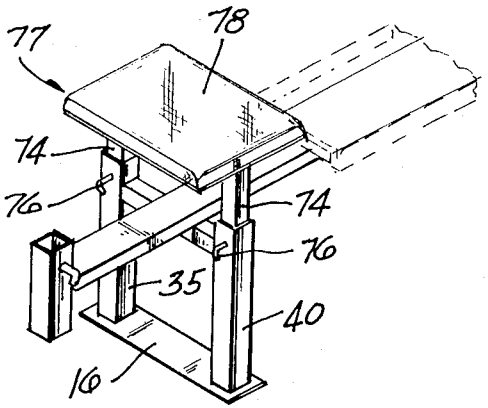
FIG. 9 is a view similar to FIG. 8 with the wrist curl attachment.

Indicated generally by the reference numeral 77 in FIG. 9 is an additional secondary body support defining a wrist curl pad 78 which is disposed horizontally and generally parallel to the body support of the basic bench. In general, the structure and operation and adjustment means are similar to those described with respect to the arm curl unit of FIG. 8.

Figure 10:
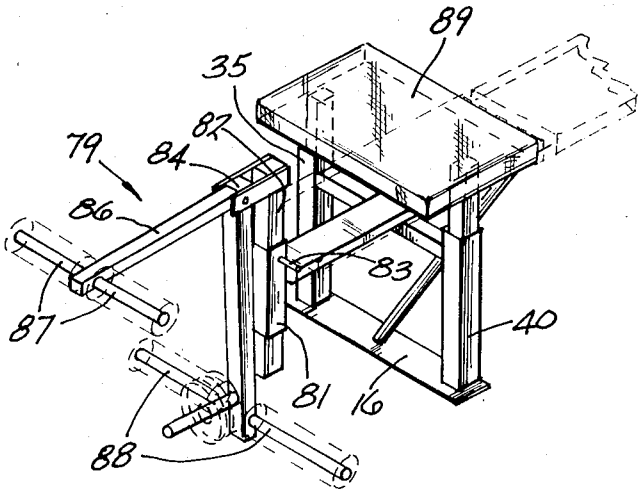
FIG. 10 is a further view of the right end of FIG. 1 with the leg extension accessory in place.

FIG. 10 shows a still further accessory unit in that an assembly indicated generally by the reference numeral 79 defines a combined leg extension and leg curl unit received in a single central socket 81 fixed to the forward or right side of the basic bench as is most apparent in FIGS. 1 and 2. The assembly 79 includes a vertical leg 82 adjustably secured in the socket by clamp 83 and supports bracket member 84 providing a bearing or pivot point for an angle frame 86. One arm of the angle frame terminates in a pair of opposed upholstered or cushioned stub shafts 87 and the other arm thereof terminates in a similarly fashioned pair of opposed stub shafts 88.

When a secondary body support 89 is telescopically received in the mating sockets 35 and 40 as shown in FIG. 10, an exerciser sitting upon the support 89 is able to engage stub shafts 88—88 with his feet to perform leg extensions.

Figure 11:
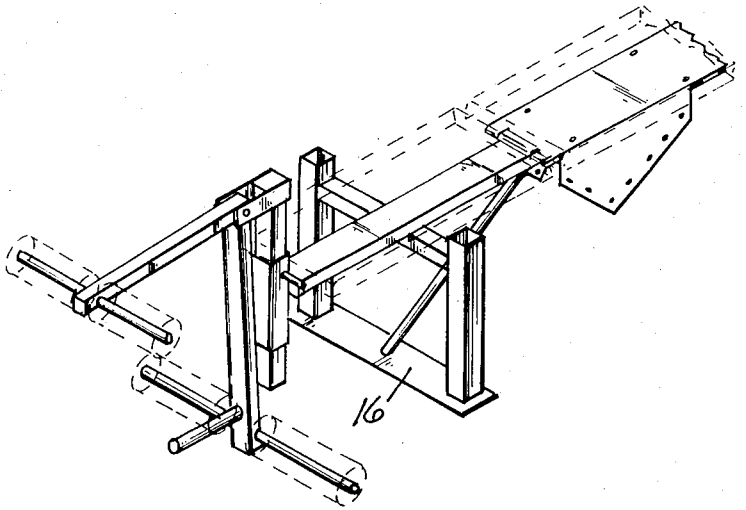
FIG. 11 shows the leg curl setup.

Upon removing the second body support 89, an exerciser lying prone on his stomach on the primary or basic bench with his head to the right is able to engage stub shafts 87—87 with the calves of his legs to perform leg curls. FIG. 11 shows the accessory 79 in the leg curl mode.

Figure 12:
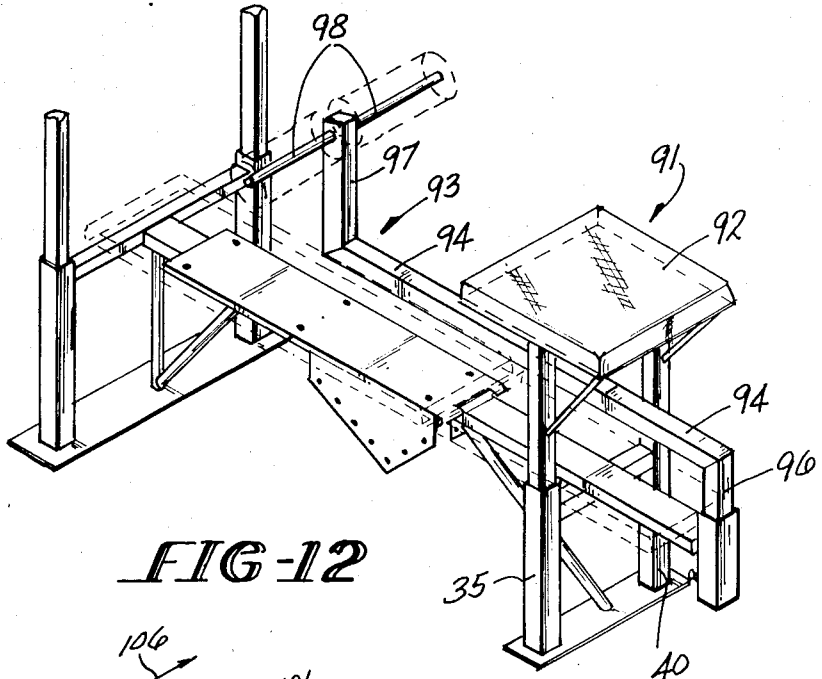
FIG. 12 shows the right end of the illustration of FIG. 1 set for "hyper-extension" exercise.

Referring to FIG. 12, a special additional exercise accessory is shown identified by the reference numeral 91 useful to perform a hyper-extension exercise. A secondary body support 92 is received and adjusted within sockets 35 and 40 in the same fashion as previously described with respect to other secondary body supports. A Z-shaped member 93 including horizontal beam 94, telescoping leg 96 and upstanding leg 98 supporting cushioned opposed stub shafts 93 identify the basic elements of this accessory.

To perform this exercise, an individual lies prone with his thighs overlaying body support 92 facing downwardly. The backs of his legs somewhere between the heel and calf area are disposed beneath opposed stub shafts 98 with the torso projecting forwardly beyond the body support 92. In this position the exerciser undertakes to flex the torso upwardly above the horizontal repeatedly.

Figure 13:
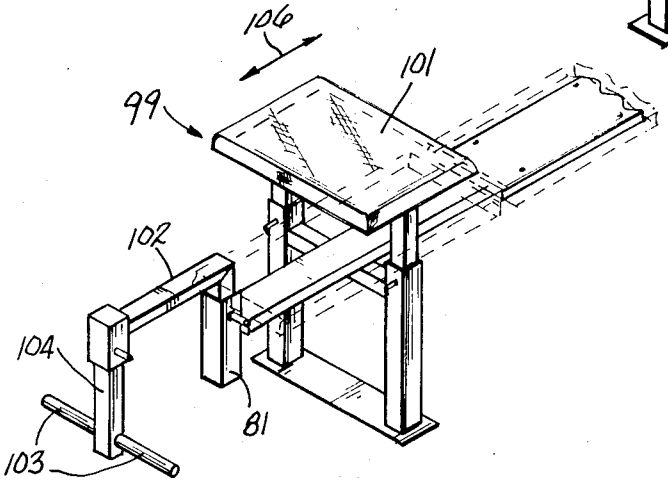
FIG. 13 is the accessory arrangement for the "Roman chair"

FIG. 13 discloses a Roman chair arrangement indicated generally by the reference numeral 99 in which a secondary body support 101 is disposed as shown in FIG. 13 and an angle bracket 102 is adjustably received in socket 81. A pair of unupholstered or uncushioned stub shafts 103 are fixed to an adjustable arm 104.

In this exercise, an individual sits upon the secondary body support 102 facing to the left as viewed in FIG. 13 and with his insteps underneath the shafts 103 flexes his upper torso to and fro in the direction indicated by the arrow labeled 106. The shafts 103 also facilitate a sit-up exercise; the exerciser sits on the floor with his feet under the shafts.

Figure 14:
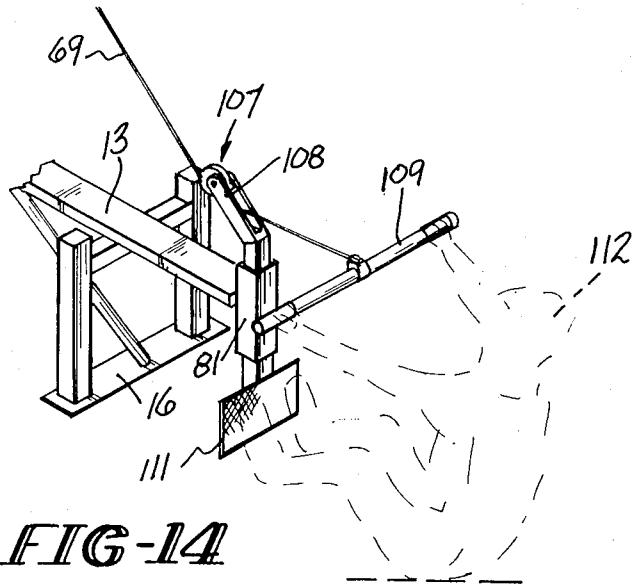
FIG. 14 shows a further pulley attachment for "rowing".

FIG. 14 discloses a rowing exercise, indicated generally by the reference numeral 107, socketed in the right side of the basic unit as viewed in FIG. 1. In this arrangement, the cable 69 (of the arrangement of FIG. 7) is extended and passed beneath an additional pulley 108 secured on the top side of socket 81 and terminates in a row bar 109. The bottom portion of socket 81 receives and clamps a treadle or fixed foot rest 111 so that an individual, shown in dotted lines at 112, sitting upon the floor places his feet against treadle 111 and exercises by effecting a rowing action with bar 109 in hand pulling against weight bar W, shown in FIG. 7.

It is anticipated that a wide variety of modifications and design changes may be effected in the present invention without departing from the spirit and scope thereof. For example, it is within the contemplation of the invention to use tubes of circular cross-section as well as those having a generally rectangular configuration in cross-section. In addition, any number of quick operating adjustment means for elevating or lowering and fixing the position of the various telescoping piece parts is entirely within the spirit of the invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An adjustable exercise bench defining a hinged, normally flat body support in the form of a truss comprising a pair of spaced tubular frames spanned and supported by a central beam, said frames being fixed individually to floor plates, a single diagonal support element individual to each frame and connecting the floor plate of each frame to the central beam to provide rigidity to the truss, a first section of said body support being fixed to the truss, a second section of said body support being hinged to the truss, both sections of said body support overhanging and projecting beyond the truss, a pair of spaced brackets fixed to the second section straddling said beam, indexing means on said brackets cooperating with said central beam for positioning said second section of said body support releasably in a plurality of angular positions relative to said first section of said body support, said indexing means including an array of pairs of registered apertures on said brackets, each pair of apertures being operable to receive and support a pin bearing directly on said central beam, a first of said tubular frames defining a pair of spaced wells or sockets operable to receive removably mating support members in telescoping fashion, each said support member having a horn or cradle for receiving and supporting a barbell, clamp means on each said socket cooperating with its mating support member for adjusting the height of a support member and thus its cradle relative to the body support, the other of said tubular frames defining a second pair of spaced sockets, a second body support having legs received telescopically and removably in said second pair of sockets, adjustment means on one of said legs and said second pair of sockets for changing the position of said second body support relative to said normally flat body support, a fifth socket fixed to one end of the bench and being disposed in a medial position, said socket being formed with a through bore and having clamp means, a leg supporting a leg bracket member is received telescopically in the through bore of said fifth socket, said bracket member being adjustable vertically by said clamp means, said bracket member having a pair of spaced flanges defining a bearing, an L-shaped angle frame supported pivotally by said bearing, said angle frame terminating at each end in a pair of opposed, outwardly projecting stub shafts, and one end of said angle frame having a fifth stub shaft projecting at right angles to an adjacent pair of opposed stub shafts, said second body support and said bracket member being adjustable relative to one another to accommodate the physique of an individual.

* * * * *